US010446968B1

(12) United States Patent
Weber, Jr. et al.

(10) Patent No.: US 10,446,968 B1
(45) Date of Patent: Oct. 15, 2019

(54) CONNECTOR ASSEMBLY WITH LOCK REINFORCEMENT FEATURE

(71) Applicant: Delphi Technologies, LLC, Troy, MI (US)

(72) Inventors: Wesley W. Weber, Jr., Metamora, MI (US); Jeffrey S. Campbell, West Bloomfield, MI (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/973,769

(22) Filed: May 8, 2018

(51) Int. Cl.
*H01R 13/424* (2006.01)
*H01R 13/436* (2006.01)

(52) U.S. Cl.
CPC ..... *H01R 13/424* (2013.01); *H01R 13/4364* (2013.01)

(58) Field of Classification Search
CPC ..... H01R 13/4223; H01R 13/4362
USPC ..... 439/595, 752
See application file for complete search history.

(56) References Cited

U.S. PATENT DOCUMENTS 9,640,905 B2 * 5/2017 Suzuki ..... H01R 13/6271
9,774,123 B2 * 9/2017 Sasaki ..... H01R 13/4364
2003/0220016 A1 * 11/2003 Tsuji ..... H01R 13/4364 439/595
2005/0095911 A1 * 5/2005 Mase ..... H01R 13/4223 439/595
2005/0186842 A1 * 8/2005 Fukatsu ..... H01R 13/4223 439/595
2005/0250385 A1 * 11/2005 Tsuji ..... H01R 13/4365 439/595
2009/0247011 A1 * 10/2009 Myer ..... H01R 13/4223 439/595
2011/0143588 A1 * 6/2011 Chikusa ..... H01R 13/4223 439/595

* cited by examiner

*Primary Examiner* — Tulsidas C Patel
*Assistant Examiner* — Marcus E Harcum
(74) *Attorney, Agent, or Firm* — Joseph Victor Bonadies

(57) ABSTRACT

A connector assembly includes an electrical-terminal, a housing, and a lock-reinforcement. The a housing defines a cavity configured to receive the electrical-terminal. The housing includes a locking-finger overlaying the electrical-terminal configured to lock the electrical-terminal within the cavity. The locking-finger has a rib protruding from the locking-finger having a first-surface and a second-surface. A tip of the locking-finger includes a locking-ramp projecting from the locking-finger configured to engage a perimeter-edge of a lock-slot defined by the electrical-terminal. The lock-reinforcement is disposed within the cavity and configured to slideably engage both the first-surface and the second-surface of the rib after the lock-reinforcement is moved from a pre-stage-position to a seated-position. The lock-reinforcement is configured to inhibit a buckling of the cantilevered locking-finger when a removal-force is applied to the electrical-terminal when the lock-reinforcement is in the seated-position, thereby inhibiting the locking-ramp from rotating within the lock-slot of the electrical-terminal.

22 Claims, 4 Drawing Sheets

CONNECTOR ASSEMBLY WITH LOCK REINFORCEMENT FEATURE

TECHNICAL FIELD OF INVENTION

This disclosure generally relates to an electrical connector assembly, and more particularly relates to an electrical connector assembly with a lock reinforcement feature.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
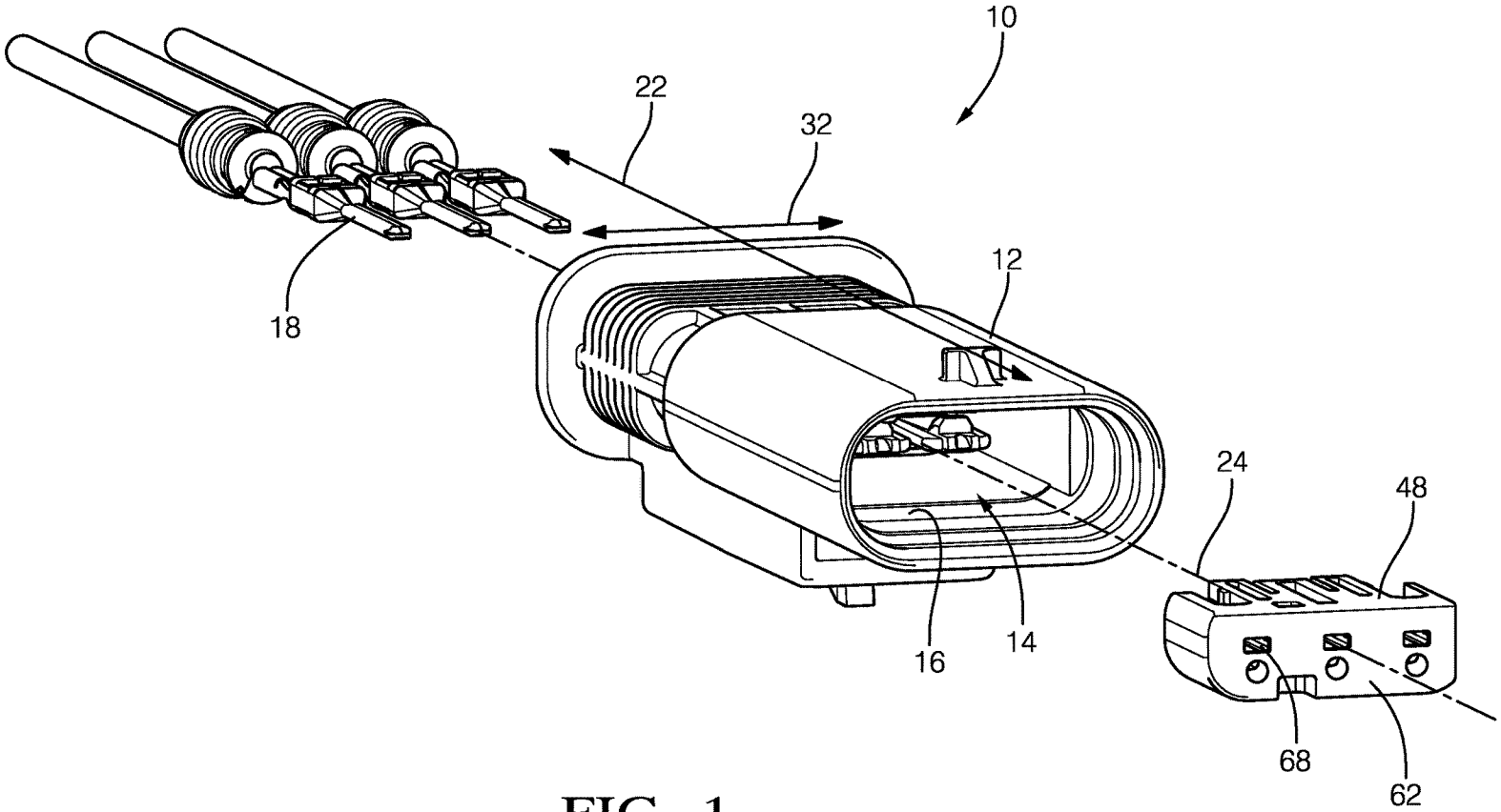
FIG. 1 is an exploded perspective view of a connector assembly in accordance with one embodiment.

FIG. 1 is an exploded view illustrating a connector assembly 10, hereafter referred to as the assembly 10. The assembly 10 includes a housing 12 defining a cavity 14 having an inner-surface 16 configured to receive an electrical-terminal 18. The housing 12 is formed of a polymeric dielectric material. The polymeric dielectric material may be any polymeric dielectric material capable of electrically isolating portions of the electrical-terminal 18, and is preferably a polyamide (NYLON) material. The electrical-terminal 18 is configured to mate with corresponding electrical-terminal of a mating-connector (not shown). The electrical-terminal 18 is formed of an electrically conductive material, such as a copper-based alloy that may also include a coating of another conductive material (e.g. tin-based and/or silver-based coating). The electrical-terminal 18 is configured to be attached to a wire cable (not specifically shown) that may be a component of a wiring-harness of a vehicle.

Figure 2:
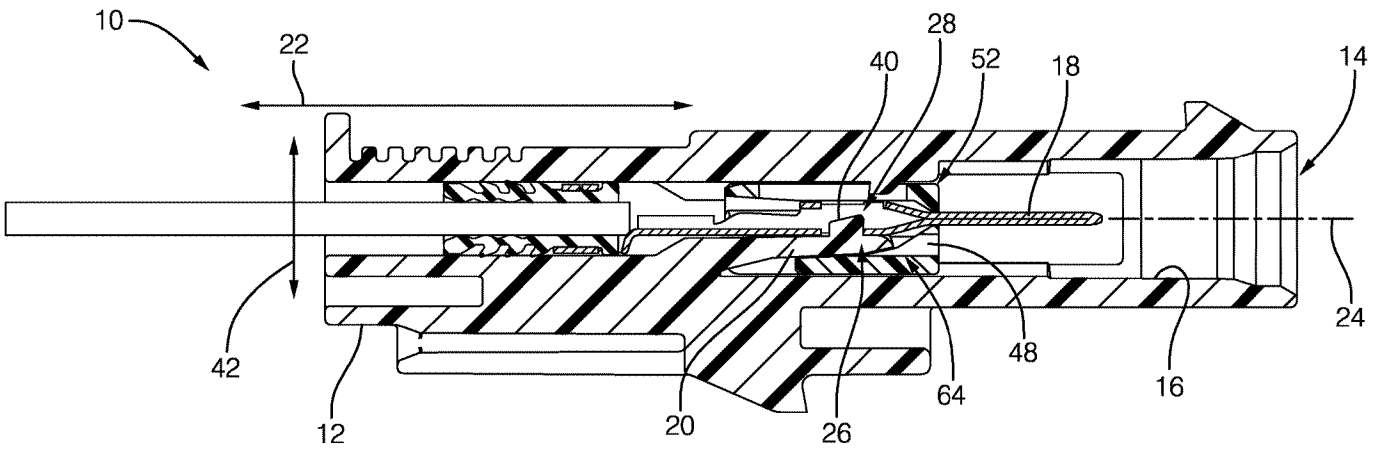
FIG. 2 is a cross section view along a centerline of the connector assembly of FIG. 1 with a lock-reinforcement in a seated-position in accordance with one embodiment.

FIG. 2 is a cross section view along a centerline of the assembly 10 of FIG. 1 with the components installed. The housing 12 includes a cantilevered locking-finger 20 extending from the inner-surface 16 along a longitudinal-axis 22 parallel to a mating-axis 24 (see FIG. 1). The cantilevered locking-finger 20 terminates at a tip 26 and is configured to overlay the electrical-terminal 18, and is further configured to lock the electrical-terminal 18 within the cavity 14 in a locked-position 28. In the example illustrated in FIGS. 1-2, the cavity 14 is configured to receive a plurality of electrical-terminals 18 and the housing 12 further includes a plurality of the cantilevered locking-fingers 20.

Figure 3:
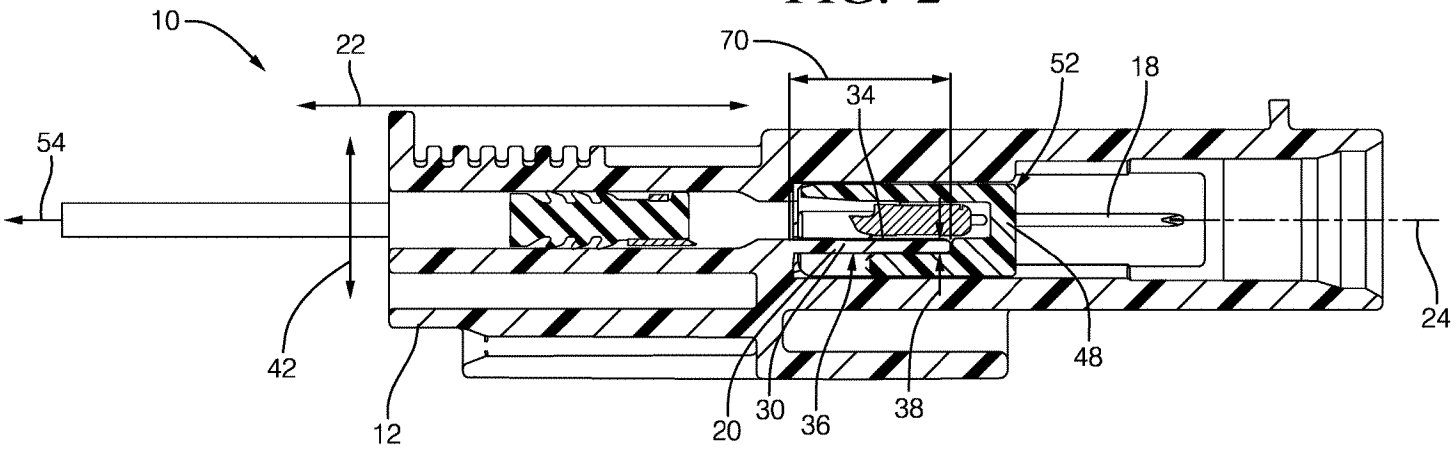
FIG. 3 is another cross section view of the connector assembly of FIG. 2 in accordance with one embodiment.
Figure 4:
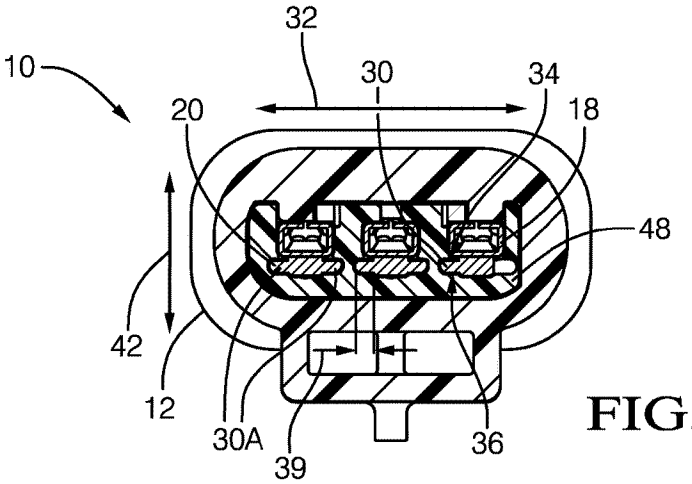
FIG. 4 is a section-view of the connector assembly of FIG. 2 viewed along a mating-axis in accordance with one embodiment.

FIG. 3 is another cross section view of the assembly 10 of FIG. 1, except at a different depth into the assembly 10 (i.e. not at the centerline), and revealing a portion of the cantilevered locking-finger 20. The cantilevered locking-finger 20 has a rib 30 protruding along a lateral-axis 32 (see FIG. 1) orthogonal to the mating-axis 24. The rib 30 has a first-surface 34 and a second-surface 36, the second-surface 36 opposite the first-surface 34 relative to both the lateral-axis 32 and the longitudinal-axis 22 of the housing 12. That is, the first-surface 34 and the second-surface 36 lay in separate, parallel, planes, and overlay one another. In the example illustrated in FIG. 3, the cantilevered locking-finger 20 includes a single rib 30 protruding along the lateral-axis 32 from one side of the cantilevered locking-finger 20, providing the cantilevered locking-finger 20 with a generally L-shaped cross section. In another embodiment illustrated in FIG. 4, the cantilevered locking-finger 20 includes a pair of opposed-ribs 30A protruding along the lateral-axis 32 from opposite sides of the cantilevered locking-finger 20, providing the cantilevered locking-finger 20 with a generally T-shaped cross section. In the example illustrated in FIG. 3, a thickness 38 of the rib 30 is in a range of 0.5 mm to 0.75 mm, and a width 39 of the rib 30 in a range of 0.75 mm to 1.0 mm. The thickness 38 and width 39 may be any thickness 38 and width 39 needed to meet the requirements of the application, and may depend on a dimension of the electrical-terminal 18.

Figure 6:
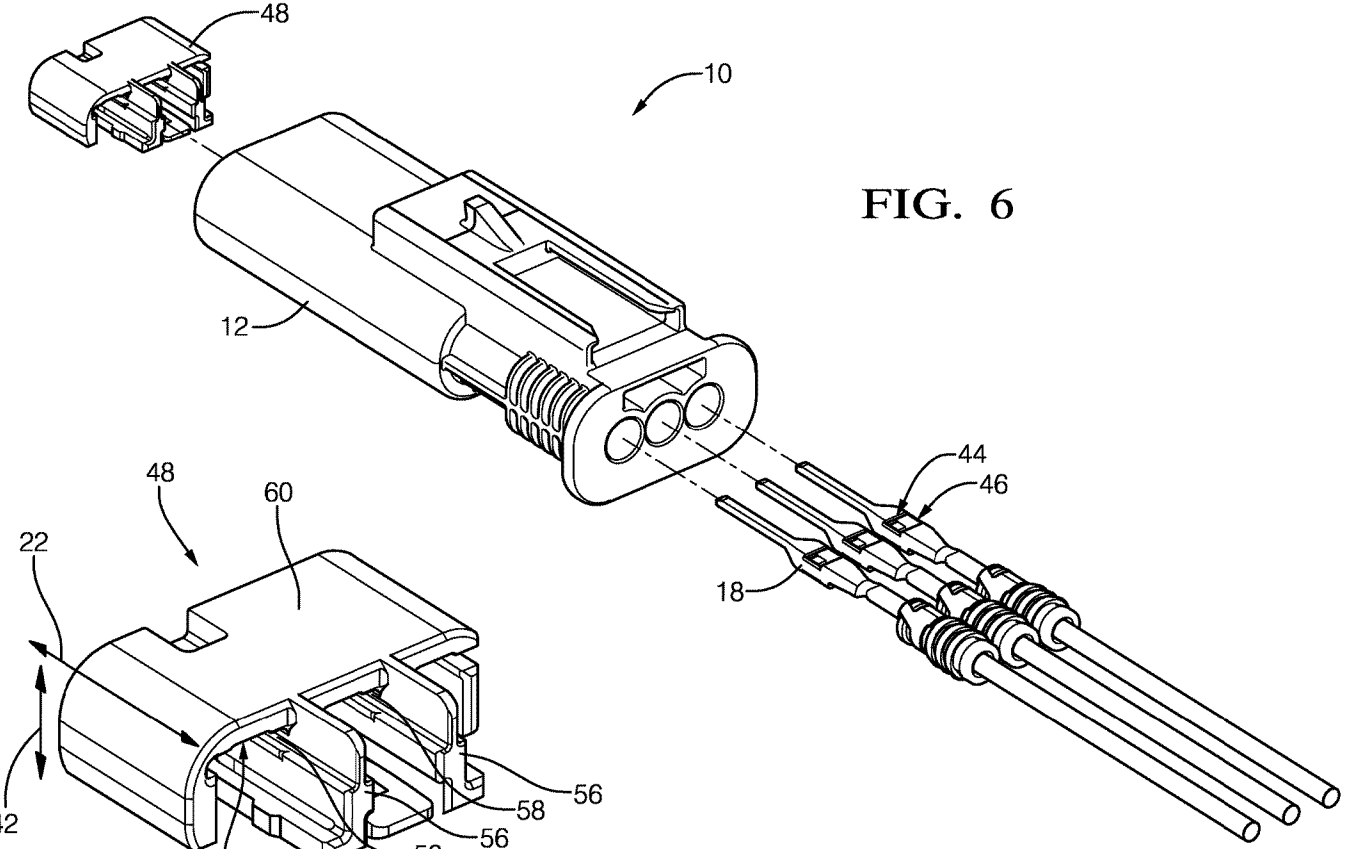
FIG. 6 is the exploded view of a connector assembly of FIG. 1 from another perspective in accordance with one embodiment.

Referring back to FIG. 2, the cantilevered locking-finger 20 includes a locking-ramp 40 projecting from the tip 26 along a vertical-axis 42 orthogonal to both the lateral-axis 32 and the longitudinal-axis 22. The locking-ramp 40 is configured to engage a perimeter-edge 44 (see FIG. 6) of a lock-slot 46 defined by the electrical-terminal 18, and inhibits a removal of the electrical-terminal 18 once locked into position. The locking-ramp 40 is designed to fail in shear when the electrical-terminal 18 is unintentionally removed by pulling forcefully on the electrical-wire, for example. A cross-sectional area of the locking-ramp 40 in the shear-plane (not shown) directly affects a retention-force of the electrical-terminal 18. As such, maintaining the maximum cross-sectional area of the locking-ramp 40 in the shear-plane is advantageous to a durability of the assembly 10.

Figure 5:
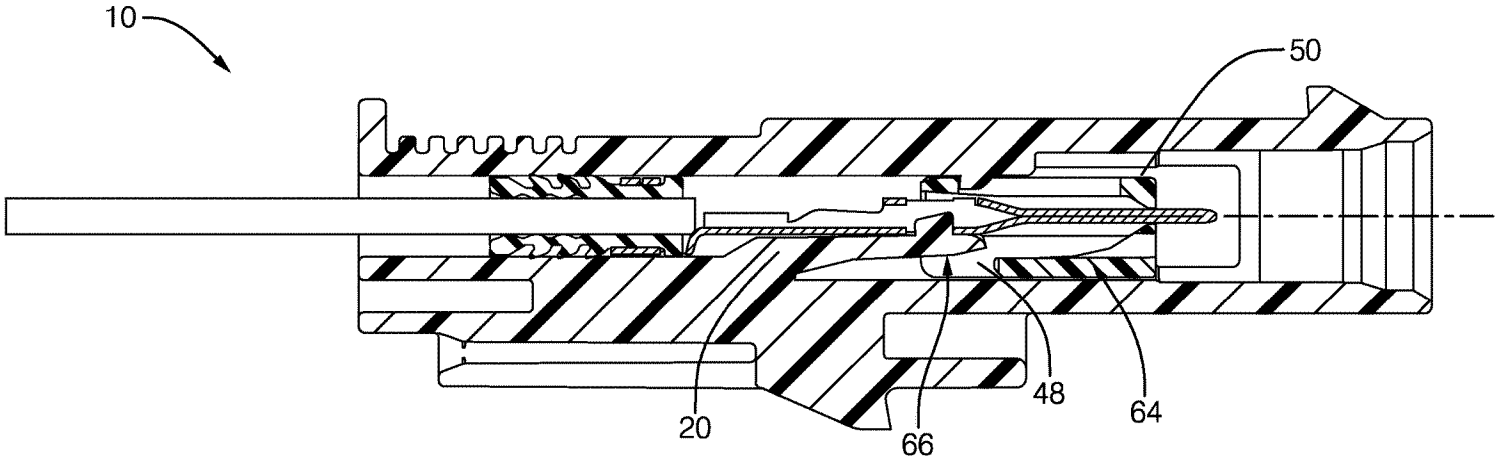
FIG. 5 is another cross section view of the connector assembly of FIG. 2 with the lock-reinforcement in a pre-stage-position in accordance with one embodiment.

Referring back to FIG. 3, the assembly 10 also includes a lock-reinforcement 48 disposed within the cavity 14 configured to slideably engage both the first-surface 34 and the second-surface 36 of the rib 30 (or engage the pair of opposed-ribs 30A) after the lock-reinforcement 48 is moved from a pre-stage-position 50 (see FIG. 5) to a seated-position 52. In the seated-position 52 the lock-reinforcement 48 is configured to inhibit a buckling (i.e. bending, bowing, deflection, etc.) of the cantilevered locking-finger 20 along the vertical-axis 42 when a removal-force 54 is applied to the electrical-terminal 18 in the locked-position 28, thereby inhibiting the locking-ramp 40 from rotating within the lock-slot 46 of the electrical-terminal 18. This has the technical benefit of utilizing the maximum cross-sectional area of the locking-ramp 40 in the shear-plane to resist against the removal-force 54. Analysis by the inventors has discovered an improvement in a buckling-load of greater than 3.5 times over prior art designs, which results in an increase in a retention-force of the electrical-terminal 18 in excess of 30%.

Figure 7:
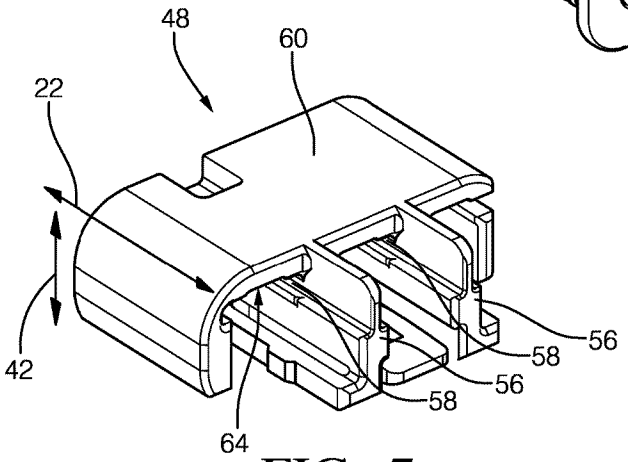
FIG. 7 is a perspective view of the lock-reinforcement of the connector assembly FIG. 6 isolated from the connector assembly in accordance with one embodiment.

FIG. 7 illustrates the lock-reinforcement 48 isolated from the assembly 10. The lock-reinforcement 48 includes a wall 56 extending along the longitudinal-axis 22 in a direction opposite the cantilevered locking-finger 20 and parallel to the vertical-axis 42. The wall 56 defines rib-slots 58 configured to slideably engage both the first-surface 34 and the second-surface 36 of the rib 30 after the lock-reinforcement 48 is moved from the pre-stage-position 50 to the seated-position 52. The lock-reinforcement 48 also includes a skirt 60 extending from a face 62 (see FIG. 1) of the lock-reinforcement 48 along the longitudinal-axis 22 in the direction opposite the cantilevered locking-finger 20, and orthogonal to the wall 56. The face 62 of the lock-reinforcement 48 defines an aperture 68 configured to slideably engage the electrical-terminal 18 when the lock-reinforcement 48 is moved from the pre-stage-position 50 to the seated-position 52.

The skirt 60 is configured to slideably engage the inner-surface 16 of the cavity 14 when the lock-reinforcement 48 is moved from the pre-stage-position 50 to the seated-position 52. The skirt 60 defines an inner-platform 64 configured to engage a portion of a bottom-surface 66 of the cantilevered locking-finger 20 after the lock-reinforcement 48 is moved from the pre-stage-position 50 to the seated-position 52. In addition, the rib-slots 58 of the lock-reinforcement 48 slideably engage at least 40% of a length 70 of the rib 30 (or pair of opposed-ribs 30A) after the lock-reinforcement 48 is moved to the seated-position 52, as illustrated in FIG. 3. This has the technical benefit of increasing an effective column-length of the cantilevered locking-finger 20 and reduces an Euler K-factor. Analysis by the inventors has discovered that the improvements described herein increase the removal-force 54 required to remove the electrical-terminal 18 from the locked-position 28 in excess of 25%.

Accordingly, a connector assembly 10 is provided. The connector assembly 10 is an improvement over prior art connector-assemblies because the connector assembly 10 has the lock-reinforcement 48 that inhibits the locking-ramp 40 from rotating within the lock-slot 46 of the electrical-terminal 18, thereby increasing the electrical-terminal 18 retention-force.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector assembly, comprising:

a housing defining a cavity having an inner-surface configured to receive an electrical-terminal;

said housing including a cantilevered locking-finger extending from the inner-surface along a longitudinal-axis parallel to a mating-axis terminating at a tip;

said cantilevered locking-finger configured to overlay the electrical-terminal;

said cantilevered locking-finger further configured to lock the electrical-terminal within the cavity in a locked-position;

said cantilevered locking-finger having a rib protruding along a lateral-axis orthogonal to the mating-axis;

said rib having a first-surface and a second-surface, the second-surface opposite the first-surface relative to both the lateral-axis and the longitudinal-axis; and a lock-reinforcement disposed within the cavity configured to slideably engage both the first-surface and the second-surface of the rib after the lock-reinforcement is moved from a pre-stage-position to a seated-position.

2. The connector assembly in accordance with claim 1, wherein the cantilevered locking-finger includes a pair of opposed-ribs protruding from the cantilevered locking-finger along the lateral-axis from opposite sides of the cantilevered locking-finger, providing the cantilevered locking-finger with a generally T-shaped cross section.

3. The connector assembly in accordance with claim 1, wherein the cantilevered locking-finger includes a single rib protruding from the cantilevered locking-finger along the lateral-axis from one side of the cantilevered locking-finger, providing the cantilevered locking-finger with a generally L-shaped cross section.

4. The connector assembly in accordance with claim 1, wherein the cavity is further configured to receive a plurality of electrical-terminals and the housing further includes a plurality of cantilevered locking-fingers.

5. The connector assembly in accordance with claim 1, wherein the lock-reinforcement includes a wall extending along the longitudinal-axis in a direction opposite the cantilevered locking-finger and parallel to a vertical-axis, said wall defining rib-slots configured to slideably engage both the first-surface and the second-surface of the rib after the lock-reinforcement is moved from the pre-stage-position to the seated-position.

6. The connector assembly in accordance with claim 5, wherein the lock-reinforcement includes a skirt extending from a face of the lock-reinforcement along the longitudinal-axis in the direction opposite the cantilevered locking-finger, said skirt orthogonal to the wall, said skirt configured to slideably engage the inner-surface of the cavity when the lock-reinforcement is moved from the pre-stage-position to the seated-position.

7. The connector assembly in accordance with claim 6, wherein the face defines an aperture configured to slideably engage the electrical-terminal when the lock-reinforcement is moved from the pre-stage-position to the seated-position.

8. The connector assembly in accordance with claim 6, wherein the skirt defines an inner-platform configured to engage a portion of a bottom-surface of the cantilevered locking-finger after the lock-reinforcement is moved from the pre-stage-position to the seated-position.

9. The connector assembly in accordance with claim 1, wherein the lock-reinforcement slideably engages at least 40% of a length of the rib after the lock-reinforcement is moved from the pre-stage-position to the seated-position.

10. A connector assembly, comprising:

an electrical-terminal configured to mate with a corresponding electrical-terminal of a mating-connector;

a housing defining a cavity having an inner-surface configured to receive the electrical-terminal;

said housing including a cantilevered locking-finger extending from the inner-surface along a longitudinal-axis parallel to a mating-axis terminating at a tip;

said cantilevered locking-finger overlaying the electrical-terminal and configured to lock the electrical-terminal within the cavity in a locked-position;

said cantilevered locking-finger having a rib protruding along a lateral-axis orthogonal to the mating-axis;

said rib having a first-surface and a second-surface, the second-surface opposite the first relative to both the lateral-axis and the longitudinal-axis; and a lock-reinforcement disposed within the cavity configured to slideably engage both the first-surface and the second-surface of the rib after the lock-reinforcement is moved from a pre-stage-position to a seated-position.

11. The connector assembly in accordance with claim 10, wherein the cantilevered locking-finger includes a pair of opposed-ribs protruding from the cantilevered locking-finger along the lateral-axis from opposite sides of the cantilevered locking-finger, providing the cantilevered locking-finger with a generally T-shaped cross section.

12. The connector assembly in accordance with claim 10, wherein the cantilevered locking-finger includes a single rib protruding from the cantilevered locking-finger along the lateral-axis from one side of the cantilevered locking-finger, providing the cantilevered locking-finger with a generally L-shaped cross section.

13. The connector assembly in accordance with claim 10, wherein the cavity is further configured to receive a plurality of electrical-terminals and the housing further includes a plurality of cantilevered locking-fingers.

14. The connector assembly in accordance with claim 10, wherein the lock-reinforcement includes a wall extending along the longitudinal-axis in a direction opposite the cantilevered locking-finger and parallel to a vertical-axis, said wall defining rib-slots configured to slideably engage both the first-surface and the second-surface of the rib after the lock-reinforcement is moved from the pre-stage-position to the seated-position.

15. The connector assembly in accordance with claim 14, wherein the lock-reinforcement includes a skirt extending from a face of the lock-reinforcement along the longitudinal-axis in the direction opposite the cantilevered locking-finger, said skirt orthogonal to the wall, said skirt configured to slideably engage the inner-surface of the cavity when the lock-reinforcement is moved from the pre-stage-position to the seated-position.

16. The connector assembly in accordance with claim 15, wherein the face defines an aperture configured to slideably engage the electrical-terminal when the lock-reinforcement is moved from the pre-stage-position to the seated-position.

17. The connector assembly in accordance with claim 15, wherein the skirt defines an inner-platform configured to engage a portion of a bottom-surface of the cantilevered locking-finger after the lock-reinforcement is moved from the pre-stage-position to the seated-position.

18. The connector assembly in accordance with claim 10, wherein the lock-reinforcement slideably engages at least 40% of a length of the rib after the lock-reinforcement is moved from the pre-stage-position to the seated-position.

19. The connector assembly in accordance with claim 1, wherein the tip includes a locking-ramp projecting from the tip along a vertical-axis orthogonal to both the lateral-axis and the longitudinal-axis;

the locking-ramp configured to engage a perimeter-edge of a lock-slot defined by the electrical-terminal.

20. The connector assembly in accordance with claim 19, wherein the lock-reinforcement is configured to inhibit a buckling of the cantilevered locking-finger when a removal-force is applied to the electrical-terminal in the locked-position and when the lock-reinforcement is in the seated-position, thereby inhibiting the locking-ramp from rotating within the lock-slot of the electrical-terminal.

21. The connector assembly in accordance with claim 10, wherein the tip includes a locking-ramp projecting from the tip along a vertical-axis orthogonal to both the lateral-axis and the longitudinal-axis, said locking-ramp engaging a perimeter-edge of a lock-slot defined by the electrical-terminal.

22. The connector assembly in accordance with claim 21, wherein the lock-reinforcement is configured to inhibit a buckling of the cantilevered locking-finger when a removal-force is applied to the electrical-terminal in the locked-position and when the lock-reinforcement is in the seated-position, thereby inhibiting the locking-ramp from rotating within the lock-slot of the electrical-terminal.

* * * * *